US005546613A

United States Patent [19]

Davenport

[11] Patent Number: 5,546,613

[45] Date of Patent: Aug. 20, 1996

[54] MULTI-PURPOSE WATER PRESSURE PLUNGER

[76] Inventor: Clyde F. Davenport, P.O. Box 8127, Greenwood, S.C. 29649

[21] Appl. No.: 420,445

[22] Filed: Apr. 10, 1995

Related U.S. Application Data

[63] Continuation of Ser. No. 132,109, Oct. 5, 1993, abandoned, which is a continuation-in-part of Ser. No. 33,942, Feb. 16, 1993, Pat. No. 5,261,128, which is a continuation of Ser. No. 799,351, Nov. 27, 1991, abandoned, which is a continuation-in-part of Ser. No. 498,287, Mar. 23, 1990, Pat. No. 5,020, 166.

[51] Int. Cl.[6] ..... E03D 11/00

[52] U.S. Cl. ..... 4/255.05

[58] Field of Search ..... 4/252.04–255.09, 4/255.03, 255.11, 255.12

[56] References Cited

U.S. PATENT DOCUMENTS

| | | | |
|---|---|---|---|
| 1,745,923 | 2/1930 | Frizzell | 4/255.06 |
| 1,821,900 | 9/1931 | Silvers | 4/255 X |
| 1,836,202 | 12/1931 | Teigeler | 4/255.11 |
| 3,023,428 | 6/1962 | Otteson | 4/255.04 |
| 3,537,113 | 11/1970 | Elzner . | |
| 4,238,860 | 12/1980 | Dixon | 4/255.08 |
| 4,320,539 | 3/1982 | Li . | |
| 4,622,702 | 11/1986 | Allen . | |
| 4,674,137 | 6/1987 | Girse . | |
| 4,768,237 | 9/1988 | Torti | 4/255.05 |

FOREIGN PATENT DOCUMENTS

| | | | |
|---|---|---|---|
| 0636518 | 5/1950 | United Kingdom | 4/255.11 |

*Primary Examiner*—Charles E. Phillips
*Attorney, Agent, or Firm*—Hardaway Law Firm PA

[57] ABSTRACT

A multi-purpose water pressure plunger is provided having a compressible cup defining an interior cavity and having a solid rubber upper portion with a top and a bottom. The cup has an outer wall which extends to form a barrel-like bottom with edges for partially extending into and sealing against walls of a drain opening. The upper portion of the compressible cup has a central passage defined therethrough beginning in a first opening at the top of the upper portion and terminating in a second opening at the bottom of the upper portion. An elongated handle is attached to the top of the upper portion and has a lengthwise aperture therethrough. The water pressure plunger includes a rubber member with a central passage removably and interchangeably attachable to the bottom of the upper portion inside the interior cavity of the compressible cup and to the handle or a valve thereon. The central passage of the rubber member terminates in a nipple-shaped end for fitting into and sealing against a drain opening. A hand-held water pressure plunger is also disclosed which utilizes the removable rubber member and includes a handle portion having a first passage therethrough communicating with a second passage which extends into the rubber member.

1 Claim, 10 Drawing Sheets

MULTI-PURPOSE WATER PRESSURE PLUNGER

CROSS REFERENCE TO RELATED APPLICATIONS

This application is a continuation of application Ser. No. 08/132,109, filed on Oct. 5, 1993, now abandoned, which is continuation-in-part of application Ser. No. 08/033,942, filed Feb. 16, 1993, U.S. Pat. No. 5,261,128 which was a continuation of application Ser. No. 07/799,351, filed Nov. 27, 1991, now abandoned, which was a continuation-in-part of application Ser. No. 07/498,287, filed Mar. 23, 1990, now U.S. Pat. No. 5,020,166.

BACKGROUND OF THE INVENTION

This invention relates generally to the art of drain clearing devices, and more particularly, to drain clearing devices which utilize pressurized water to eliminate drainage obstructions which occur in bathroom pipes and the like.

The art of unclogging drainage pipes is well known and has conventionally employed manually-operated devices of the type comprising a resiliently collapsible, rounded cup having an open interior cavity. Attached to the cup is an elongated handle element extending from the end thereof opposite the open interior cavity. The cup is placed over a drainage entrance, and by applying a downward and upward force to the handle, the cup is alternately compressed and expanded. The suction caused by this motion is somewhat effective in loosening small drainage clogs, however, larger obstructions may not be budged by such manual devices. One such device is disclosed in U.S. Pat. No. 4,622,702 to Allen wherein a manually operated plunger includes a collapsible cup for covering and sealing around a drain opening.

U.S. Pat. No. 4,674,137 to Girse discloses an electrically operated cup attached to a manually operated pumping member.

The art of clearing drainage pipes has also employed pressurized water for forcing a clog from its lodged position into the sewer system. These pressurized devices are of the type comprising a resilient drain sealing member of differing shapes and sizes. An elongated handle, having a lengthwise passage therethrough, communicates with the sealing member and extends from the end thereof opposite the sealing member. A flow of pressurized water passes into and through the handle consequently entering the drain which is proportionately embraced by the sealing member.

One such device is disclosed in U.S. Pat. No. 3,537,113 to Elzner wherein a collapsible cup of the conventional type covers and seals around the opening of a drain. A flow of pressurized water, controlled by a faucet-type valve, passes through the handle and into the drain.

U.S. Pat. No. 4,768,237 to Torti discloses a tubular handle element attached to a mushroom-shaped cup having a check valve to prevent a backflow of water. A female means on the opposite end of the handle allows the connection to a pressurized source of water.

U.S. Pat. No. 4,320,539 to Li discloses an elongated pipe with a manually operated plunger valve which activates a flow of pressurized water. A side arm, branching from and communicating with the pipe, is attached to a source of pressurized water by a male means of connection.

Other prior art devices that teach utilizing water pressure to clear clogged drains include U.S. Pat. Nos. 2,267,064 to Wikelund, 2,736,906 to Ramseur, 3,023,428 to Otteson, 4,238,860 to Dixon, and 2,039,792 to Harder.

While the above prior art devices may perform satisfactorily in many instances, they are often incapable of providing a sanitary and efficient means of unclogging bathroom drains and the like. In particular, the drain clearing devices of the prior art are not constructed to allow for a secure enough seal of a drain opening, they do not permit the correct thrust of pressurized water to a clog, and they do not afford themselves to easy operation by the ultimate consumer. Furthermore, many of the prior art devices require the use of two hands to best utilize the devices, and accordingly, there exists room for improvement for a drain clearing device which provides for ease of use and can be utilized with one hand when desired.

SUMMARY OF THE INVENTION

It is therefore an object of this invention to provide a multi-purpose water pressure plunger of the type transcending the incumberences of the prior art.

It is another object of this invention to provide a multi-purpose water pressure plunger and process of using same which is safe, easy to use and which connects to a standard source of pressurized water.

It is a further object of this invention to provide a multipurpose water pressure plunger which can completely seal various drain openings and which generates a direct impact of pressurized water to a drainage clog.

It is a still further object of this invention to provide a multi-purpose water pressure plunger which provides a removable attachment for sealing against smaller drain openings.

It is a still further object of this invention to provide a multi-purpose water pressure plunger with components that are interchangeable for various uses.

It is a still further object of this invention to provide a multi-purpose, hand-held water pressure plunger and process of using the same.

It is a still further object of this invention to provide a multi-purpose, hand-held water pressure plunger which easily and securely connects to a standard source of pressurized water.

These, as well as other objects, are accomplished by a multi-purpose water pressure plunger employing a source of pressurized water to dislodge clogs in bathroom drainage pipes and the like. The water pressure plunger comprises a compressible cup having an interior cavity and having a solid rubber upper portion. The cup has sides which extend to form a barrel-like bottom with edges for partially extending into and sealing against walls of a drain opening. The upper portion has a central passage defined therethrough for flow of pressurized water. An elongated handle is attached to an opening of the cup and has a lengthwise aperture therethrough for flow of the pressurized water. To control the flow of pressurized water, an adjustable valve including a ball component and a regulating lever is utilized. A rubber member is provided for use with small drain openings and includes a central passage therethrough for flow of pressurized water. The rubber member can be removably attached to the bottom of the upper portion or on the other side of the compressible cup.

A multi-purpose, hand-held water pressure plunger is also provided utilizing a rubber member attached to a hand-held apparatus for controlling the flow of pressurized water therethrough.

DETAILED DESCRIPTION OF THE DRAWINGS

Figure 1:
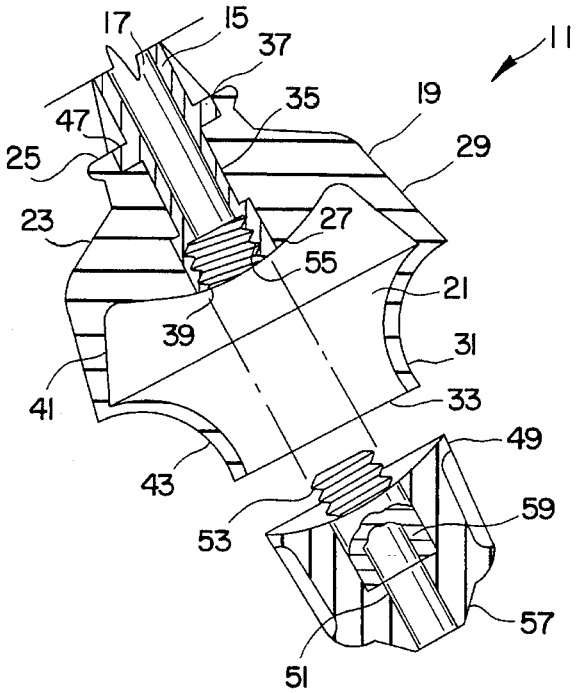
FIG. 1 of the drawings is a sectional assembly view of the water pressure plunger according to this invention.

FIG. 1 of the drawings is a sectional assembly view of the water pressure plunger 11 according to this invention. Water pressure plunger 11 comprises an elongated handle 15, best illustrated in subsequent figures, which is rigid and defines a lengthwise aperture 17. Plunger 11 further comprises a compressible cup 19 defining an interior cavity 21 therein and having a solid rubber upper portion 23 with a top 25 and a bottom 27. Compressible cup 19 has an outer wall 29 which extends to form a barrel-like bottom 31 constructed of a substantially deformable rubberized material and defining a circumferential orifice 33.

Upper portion 23 has a central passage 35 defined therethrough which is coaxial with the lengthwise aperture 17 of the handle. Central passage 35 begins in a first opening 37 and terminates in a second opening 39 positioned centrally on the bottom of upper portion 23. In the preferred embodiment, outer wall 29 of the compressible cup and likewise the interior cavity 21, has an expansive portion proximate upper portion 23 and a narrow portion at the barrel-like bottom. The expansive portion is designated generally by reference number 41 and the narrow portion is designated generally by the reference number 43. Outer wall 29 extends from upper portion 23 to form the expansive portion which preferably has a flat outer surface of increasing diameter. At the point of greatest diameter of the outer wall, which is illustrated as approximately halfway toward the barrel-like bottom, the outer wall turns inward and decreases in diameter forming the narrow portion, part of which constitutes the barrel-like bottom.

Figure 2:
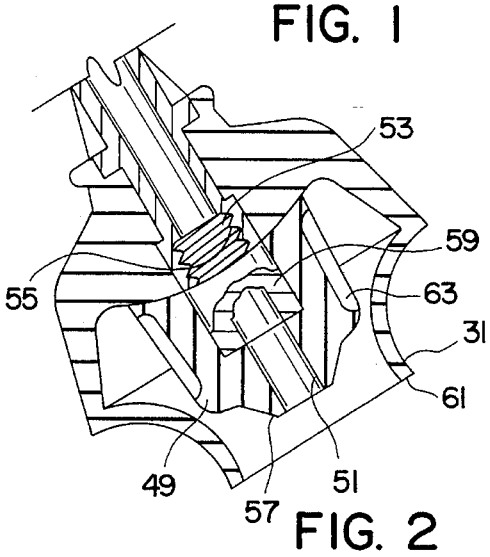
FIG. 2 of the drawings is a sectional view of the water pressure plunger according to this invention.
Figure 3:
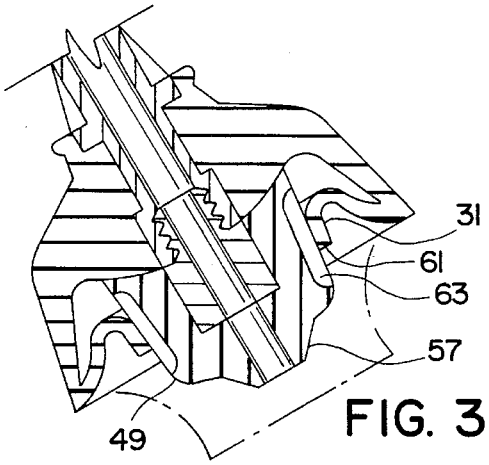
FIG. 3 of the drawings is a sectional view of the water pressure plunger according to this invention.

Elongated handle 15 has opposing end portions and extends through the top 25 of upper portion 23 terminating preferably in an open end with an attachment means at the bottom of the upper portion. A circular pressure disc 47 is recessively held within the first opening 37 of central passage 35 so that handle 15 can be inserted centrally through disc 47. It is envisioned that disc 47 be held tightly within the top of upper portion 23. Disc 47 can be separate from handle 15 and engage the handle 15 as it passes through disc 47 to provide stability and support for the handle. As illustrated in FIGS. 1–3, however, disc 47 is formed as an integral part of handle 15, a feature which enhances the ability of the handle to manipulate the plunger for sealing against a drain opening. Disc 47 therefore allows leverage for manipulating the compressible cup.

Figure 4:
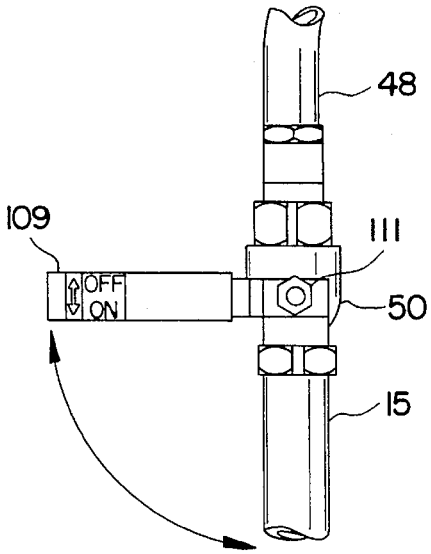
FIG. 4 of the drawings is a sectional view of an adjustable valve according to this invention.

Plunger 11 is designed to utilize a pressurized water source 48 which, as illustrated in FIG. 4 of the drawings, is connected to handle 15 through an adjustable valve 50 which provides a means for controlling the flow of pressurized water through the plunger. A flow of pressurized water passes from source 48, through valve 50, through aperture 17 within handle 15 and then through central passage 35 of plunger 11 in order to pass into and clear a drain. When clearing larger openings such as toilets, it is envisioned that barrel-like bottom 31 be utilized. When in operation to unclog things other than toilets, such as unclogging sinks or tubs, a removably attachable rubber member 49 is provided for fitting into smaller drain openings.

Figure 6:
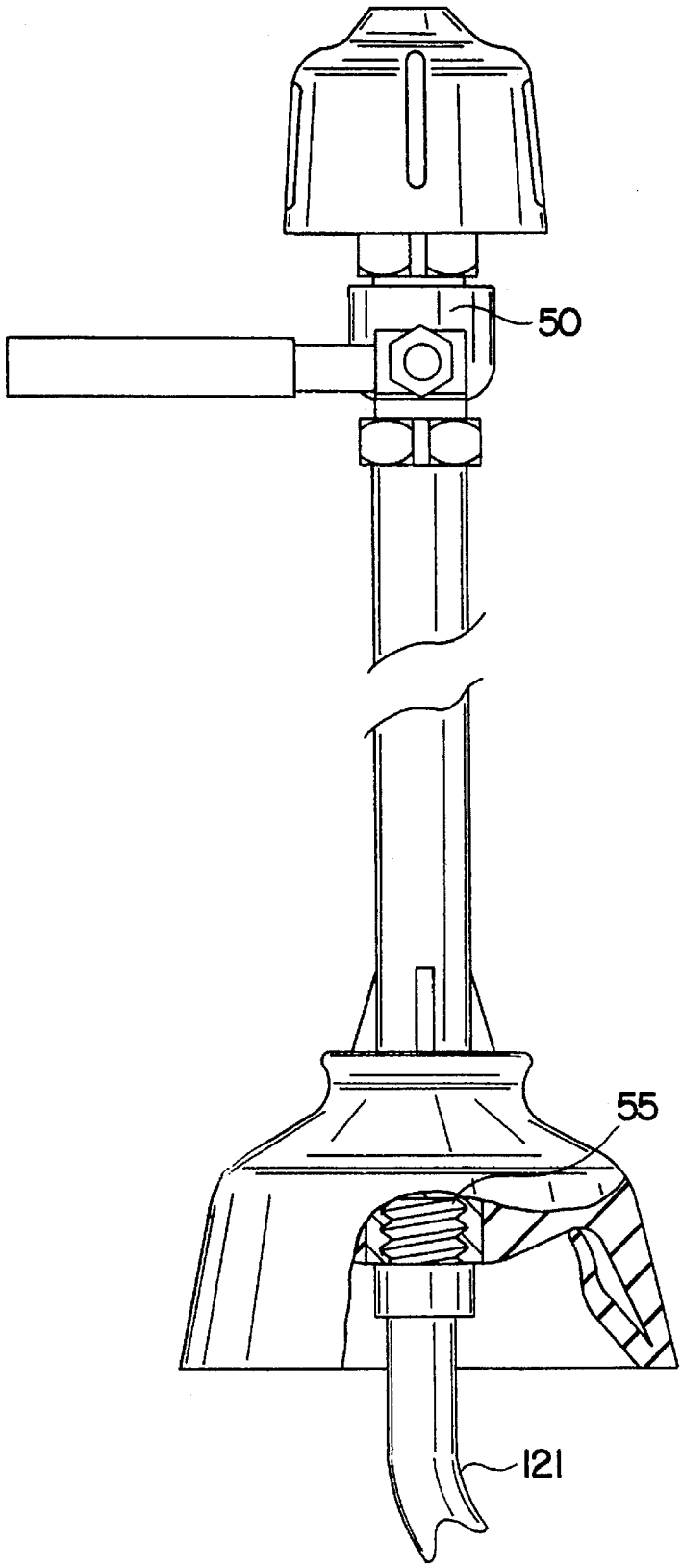
FIG. 6 of the drawings is a partially sectional, elevational view of another embodiment of the water pressure plunger according to this invention.
Figure 7:
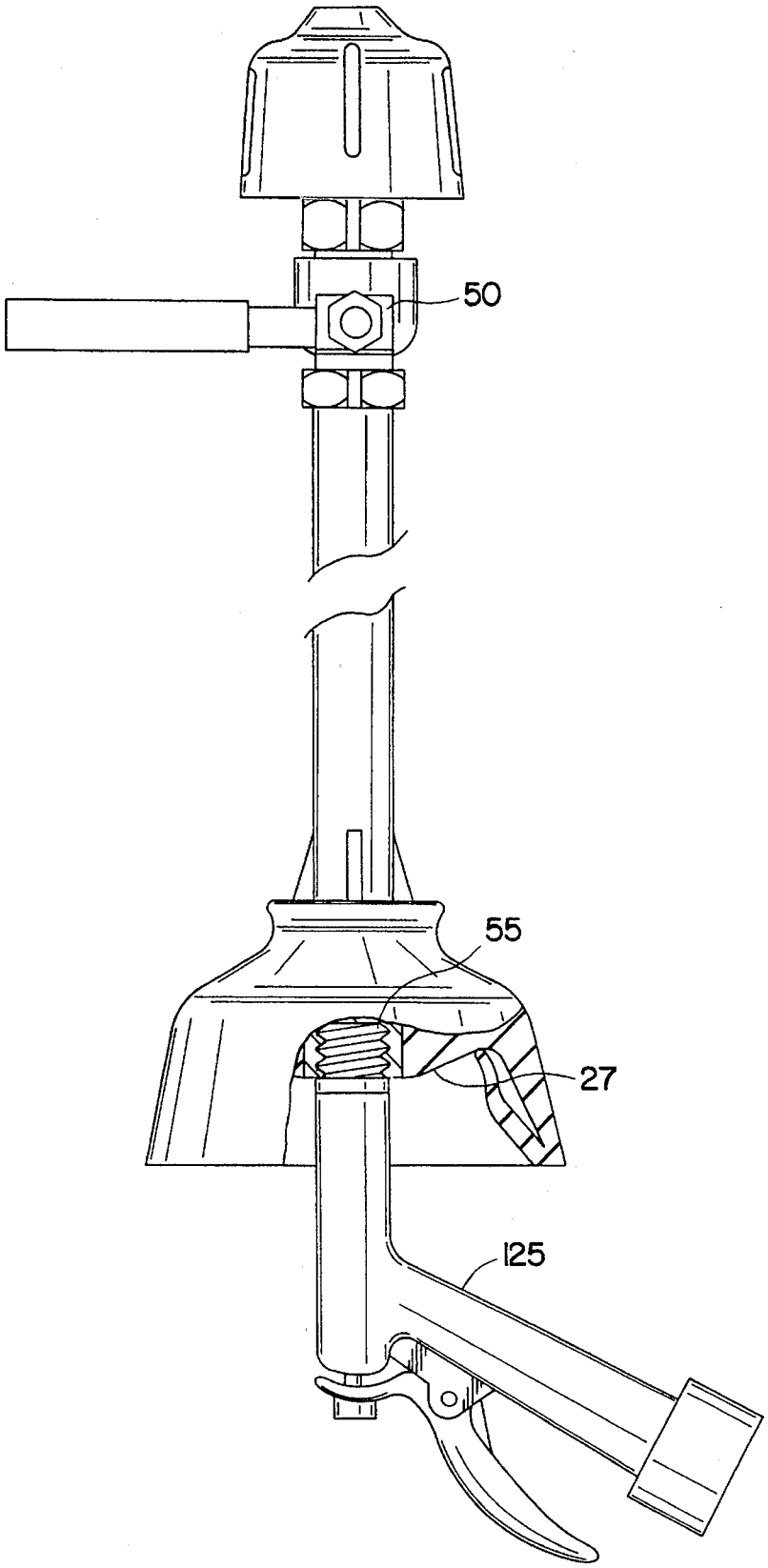
FIG. 7 of the drawing is a partially sectional, elevational view of another embodiment of the water pressure plunger according to this invention.
Figure 8:
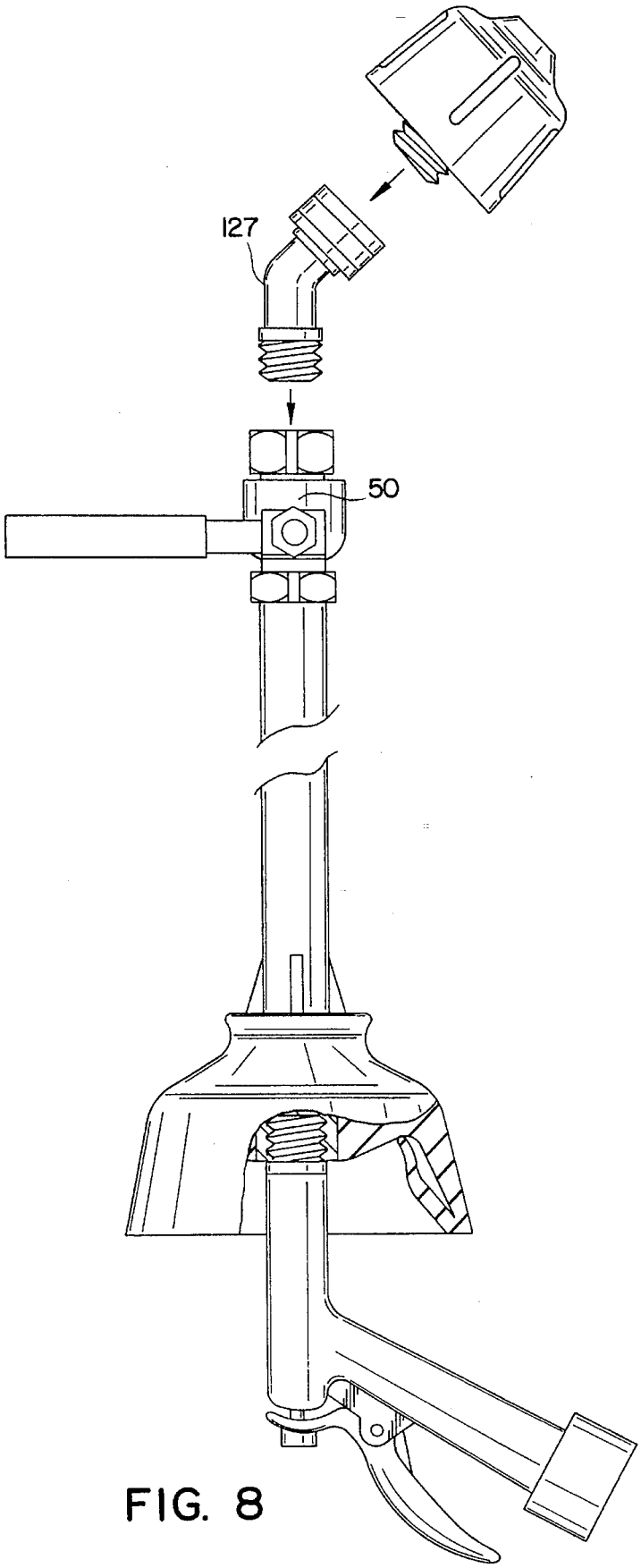
FIG. 8 of the drawings is a partially sectional, elevational view of another embodiment of the water pressure plunger according to this invention.

Rubber member 49 is illustrated in FIG. 1 of the drawings as a generally bullet-shaped solid rubber member having a central passage 51 defined therethrough. While FIGS. 1–3 illustrate the rubber member for positioning against (FIG. 1) or actually positioned against (FIGS. 2–3) the bottom of the upper portion, the rubber member can also be attached on the other side of a valve according to this invention as shown in FIGS. 6–8. Rubber member 49 includes a connection means for being removably attachable to the attachment means of the end of handle 15. The connection means of the rubber member is illustrated in the preferred embodiment as male screw-in type connection means 53. Accordingly, in the preferred embodiment, the attachment means in the second opening 39 of central passage 35 comprises female type threaded attachment means 55 positioned within central passage 35 for matingly receiving connection means 53 and thereby attaching rubber member 49 to the bottom of upper portion 23 as illustrated in its intact position in FIG. 2 of the drawings. Bottom 27 of upper portion 23 preferably comprises a smooth surface which curves downwardly with the center of bottom 27 being lower than its areas proximate to the outer wall 29. Accordingly, in the preferred embodiment, rubber member 49 has a smooth and curved surface for matingly engaging the bottom 27 of upper portion 23.

When rubber member 49 is in its attached position as illustrated in FIG. 2 of the drawings, central passage 51 of rubber member 49 preferably is coaxial with central passage 35 of upper portion 23 so that a flow of pressurized water can flow directly and unobstructed through central passage 35 and central passage 51. Central passage 51 of rubber member 49 terminates in a nipple-shaped end 57 for fitting against and into drain openings. A sleeve 59 preferably an integral extension of connection means 53 is embedded within the central passage 51 of rubber member 49 so that a smooth, cylindrical passage is formed throughout the central passage. In the preferred embodiment, sleeve 59 extends from an opening for central passage 51 which is opposite the opening of nipple-shaped end 57 to a point approximately halfway towards nipple-shaped end 57. This feature allows nipple-end 57 to be more flexibly manipulated towards its end to completely seal off a drain for clearing.

As illustrated in FIG. 2 of the drawings, rubber member 49 is completely enclosed within the interior cavity 21 of plunger 11 when rubber member 49 is tightly attached to the bottom 27 of upper portion 23. In this position, barrel-like bottom 31 with its edges 61 extend beyond nipple-end 57. To simply position rubber member 49 within the interior of cavity 21, it is envisioned that rubber member 49 be of a diameter smaller than the diameter of the circumferential orifice 33 of barrel-like bottom 31.

Figure 5:
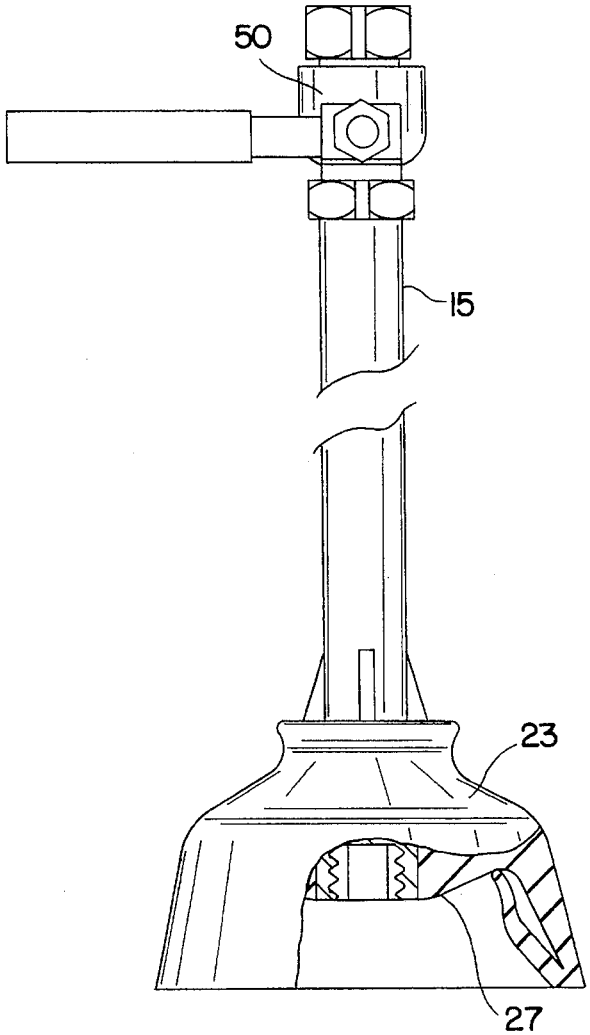
FIG. 5 of the drawings is a partially sectional, elevational view of an embodiment of the water pressure plunger according to this invention.

To facilitate the exposure of the nipple-shaped end 57 and to allow easier access to the nipple-shaped end 57 in order to seal against a drain opening, the deformable edges 61 of barrel-like bottom 31 can be pushed up in the interior cavity 21 of the compressible cup as illustrated in FIG. 3 of the drawings. It is envisioned that the edges of the barrel-like bottom be constructed so as to also be foldable or able to be rolled back into the interior cavity of the compressible cup in order to expose the nipple-shaped end. It has been found that the diameter of circumferential orifice 33 of the barrel-like bottom plays an important role in determining how the edges go up into the interior cavity of the compressible cup. When the orifice is large, the edges can be folded upward within the interior cavity. FIG. 5 of the drawings illustrates the plunger without the rubber member and with the edges of the barrel-like bottom folded upward where they will stay quite readily. When the orifice is smaller, however, it has been found that the edges can be rolled or pushed upwardly more easily than being folded as in FIG. 3 as long as the rubber member is in the interior cavity. When the rubber member is not utilized within the interior cavity and the compressible cup is used, it is better to fold the edges into the interior cavity as in FIG. 6 rather than to merely roll or push them when it is desirable to work with the edges up in the interior cavity.

Rubber member 49 preferably includes a plurality of vent grooves 63 defined on an outer surface of the rubber member. These grooves preferably extend generally parallel to the central passage 51 of the rubber member 49 and are spaced apart. Vent grooves 63 extend toward nipple-shaped end 57 and prevent an airtight fit within the interior cavity 21 of the compressible cup when the edges of the barrel-like bottom are moved up in the interior cavity. As illustrated in FIG. 3, it is preferred that the vent grooves 63 extend on rubber member 49 beyond the lowest portion of the barrel-like bottom that fits against rubber member 49 in order to allow air to pass through the vent grooves and thereby prevent an airtight seal. Vent grooves 63 also serve the purpose of enabling a person to insert a finger within vent grooves 63 to more easily grasp the barrel-like bottom and pull it back into its extended position. It is apparent, therefore, that vent grooves 63 allow the barrel-like bottom to be more easily pushed or folded towards the interior cavity and likewise moved into its extended position.

FIG. 4 of the drawings illustrates the adjustable valve 50 connected to an end of the elongated handle 15 opposite the compressible cup, and it is envisioned that the valve could be interposed anywhere along the length of the handle between a water source and the compressible cup. The adjustable valve 50 is fashioned from leak-proof and non-corrosive materials which have suitable coatings, platings, and flow characteristics for the intended application. A regulating lever 109 controls a ball component inside the valve which in turn governs the flow of water from pressurized source 48 through lengthwise aperture 17. Regulating lever 109, attached to valve 50 by a threaded screw nut 111, prohibits a flow of water when it is moved perpendicular to the elongated handle. When the regulating lever is moved downward from its "off" position, a flow of water begins. A full thrust of pressurized water is realized when the regulating lever becomes fully parallel to the elongated handle.

During operation, a pressurized source of water such as hose 48 is connected to valve 50 by attachment means. The source of pressurized water can also be a conventional hand-held valve assembly as discussed with reference to FIGS. 9 and 10. The attachment means is preferred to be the same as the attachment means in the bottom of the upper portion in the compressible cup so that the rubber member and a source of water can interchangeably be attached to the upper portion of the cup and on the other side of the valve itself or a portion of the handle communicating with the valve. When the plunger is fitted as desired to seal a drain opening, the regulating lever is pushed to allow the flow of water through the elongated handle. The tight seal of the plunger prevents a backflow of water and the regulating lever permits the appropriate flow of water to the clog.

The water pressure plunger according to this invention with the handle 15 and valve 50 is illustrated in FIG. 5 of the drawings with the rubber member absent from the interior cavity and the edges of the barrel-like bottom folded up. The valve can be turned off and the plunger can be used manually in this embodiment as plungers using suction without pressurized water to clear a drain. It has been found to be highly effective to use the plunger in such a manner and turn the valve on when the bottom 27 of upper portion 23 is against a drain to then allow the pressurized water to flow therethrough.

FIG. 6 of the drawings illustrates the embodiment of FIG. 5 with the additions of the rubber member 49 attached to valve 50 on the other side of the valve from the compressible cup and a standard source of pressurized water, illustrated as a garden hose 121, attached within the compressible cup to attachment means 55. This embodiment is quite useful for clearing small drains as it allows the rubber member to be maneuvered without the compressible cup surrounding it. Both the rubber member and the hose can simply be unscrewed from their positions as taught in reference to FIGS. 1–3 and screwed into the others former position.

FIG. 7 of the drawings shows another adaptation of the water pressure plunger according to this invention as the embodiment of FIG. 6 is shown, but with a conventional hand-held valve assembly 125 connected to the attachment means 55 of the bottom 27 instead of the water hose. By using the hand-held valve assembly in this manner, the valve 50 and the valve assembly can both be used to control the flow of pressurized water through the plunger, The valve can be opened and the hand-held valve assembly used to control the flow of water or the valve assembly can be used to allow flow therethrough while the valve is used to control flow through the rubber member.

FIG. 8 of the drawings illustrates the embodiment shown in FIG. 7 with an elbow joint 127 interposed for connection between the valve 50 and the rubber member. This embodiment is quite effective for clearing small drains in places that are difficult to effectively reach such as drains for washing machines which are usually in walls behind them.

To help hold the water pressure plunger in position, it is envisioned that the compressible cup can extend up a distance on the handle to form a grip structure as shown in FIG. 7A which can be used to hold the plunger. This is useful when the rubber member is positioned as in FIGS. 6–8 and is particularly advantageous to protect ones hands while utilizing hot water to clear a drain.

Figure 9:
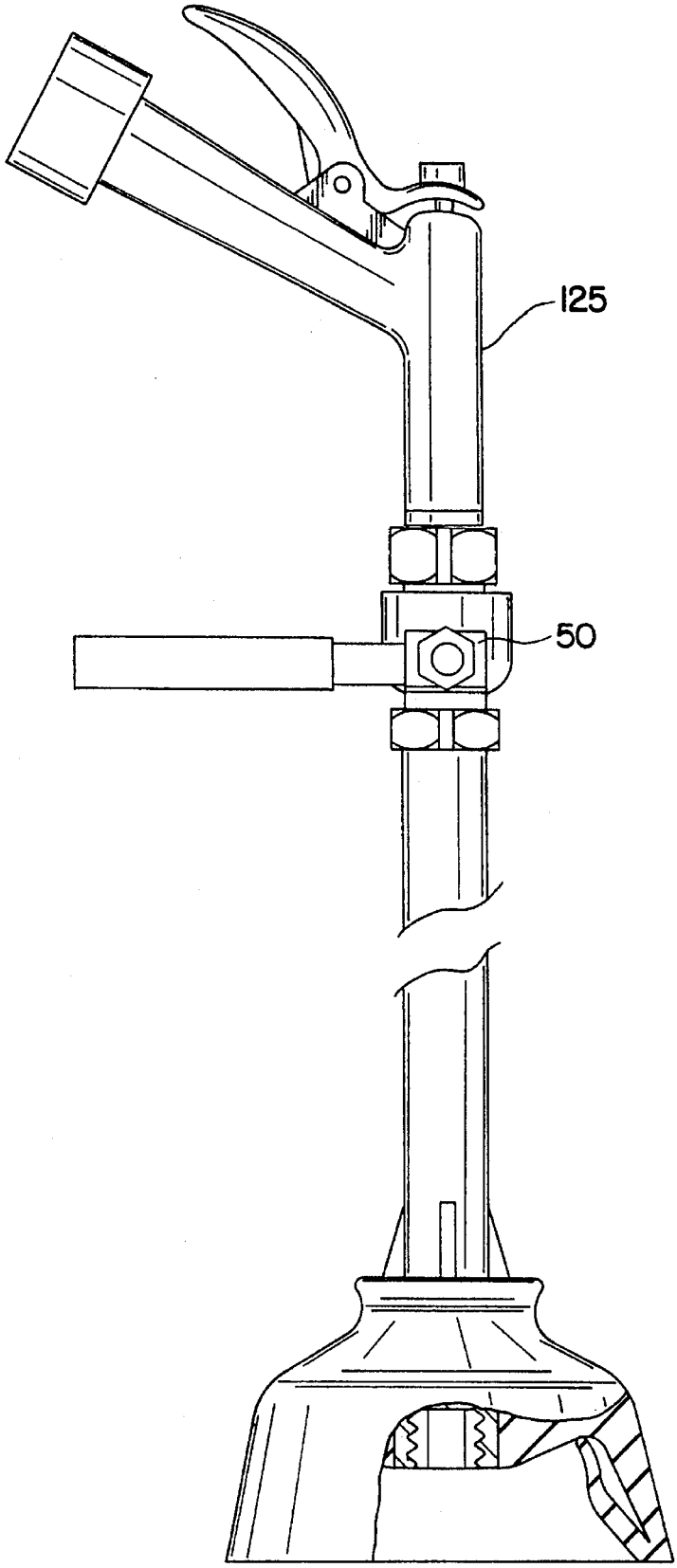
FIG. 9 of the drawings is a partially sectional, elevational view of another embodiment of the water pressure plunger according to this invention.
Figure 10:
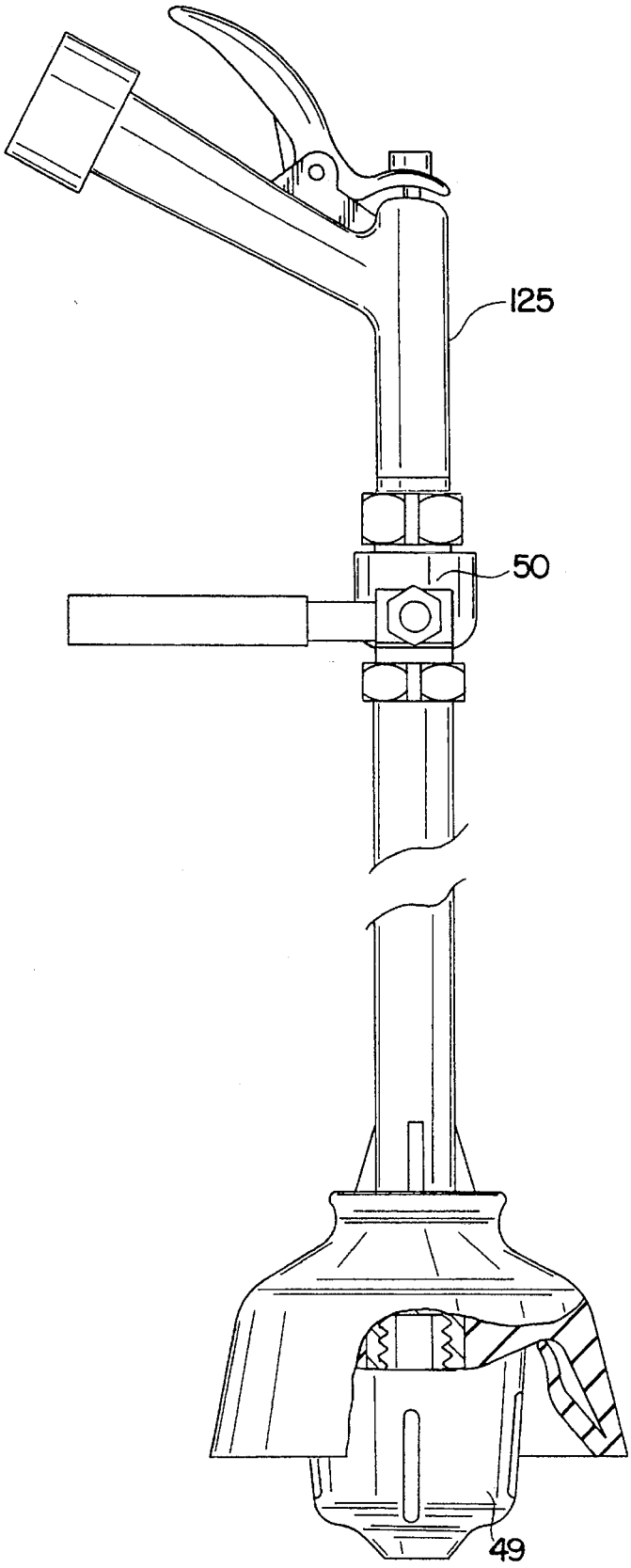
FIG. 10 of the drawings is a partially sectional, elevational view of another embodiment of the water pressure plunger according to this invention.

FIGS. 9 and 10 of the drawings illustrate another adaptation of the water pressure plunger according to this invention. The conventional valve assembly 125 is attached to the valve 50 on the other side of the valve from the compressible in FIG. 9. FIG. 10 illustrates the embodiment of FIG. 9 with the addition of the rubber member 49 attached within the compressible cup. In these embodiments, as in those in FIGS. 7 and 8, both the valve and the valve assembly can be utilized to control the flow of water. The use of a conventional valve assembly in this embodiment is particularly advantageous by allowing convenient control of the pressurized source of water other than through valve 50.

Figure 11:
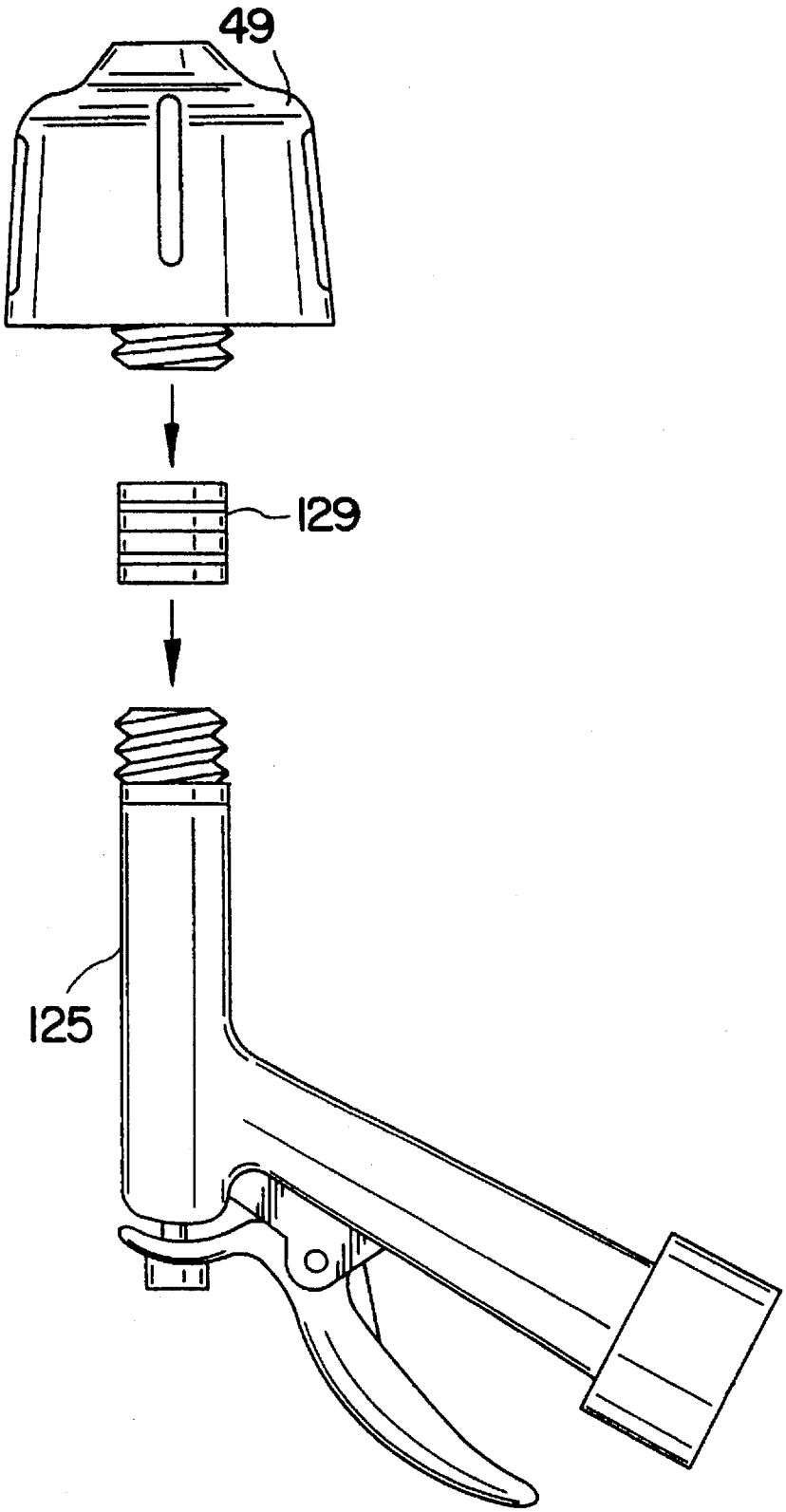
FIG. 11 of the drawings is an elevational view of a hand-held water pressure plunger according to this invention.

In yet another adaptation, the rubber member 49 is attached to the valve assembly by a coupling member 129 as shown in FIG. 11. This embodiment is very easy to assemble and to handle as the rubber member can simply be screwed into the coupling member and the other side of the coupling member can simply be screwed onto the valve assembly. This hand-held embodiment requires only the use of one hand and is quite effective for sealing against and clearing small drains. The rubber member is illustrated as bullet-shaped with a nipple-shaped end, however, it has been found that a rounded, smooth end in place of the nipple-shaped end also works well.

Figure 12:
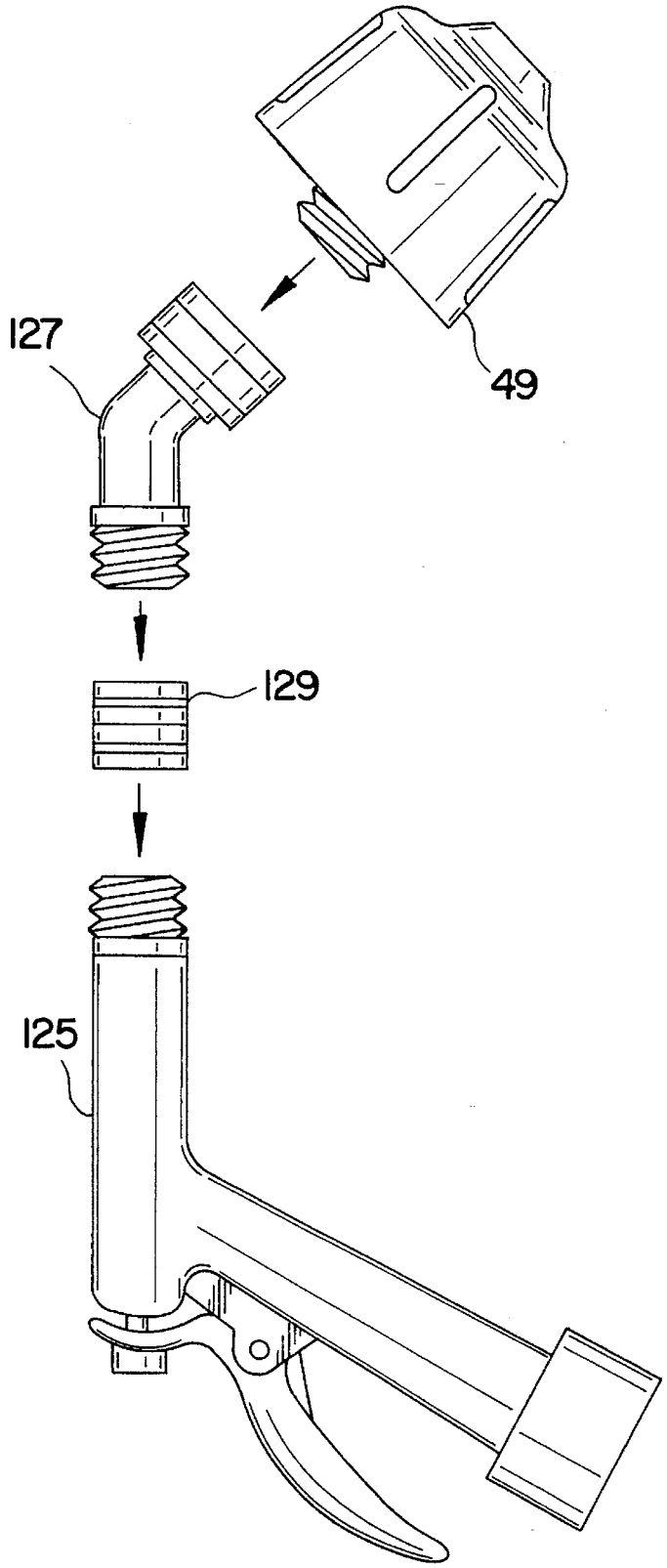
FIG. 12 of the drawings is an elevational view of a hand-held water pressure plunger according to this invention.

FIG. 12 illustrates the embodiment of FIG. 11 with an elbow joint used in FIG. 8 interposed the connection between the coupling member and the rubber member. The elbow joint bends approximately 45° and is particularly advantageous for reaching, sealing against, and clearing small drains in hard-to-get places such as washing machine drains typically in the wall behind a washing machine.

A very simplistic use of the rubber member according to this invention, and one within the scope of this invention, is to attach a source of pressurized water directly to the rubber member. This allows drains to be cleared by manually positioning the rubber member to seal and then clear the drain.

Figure 13:
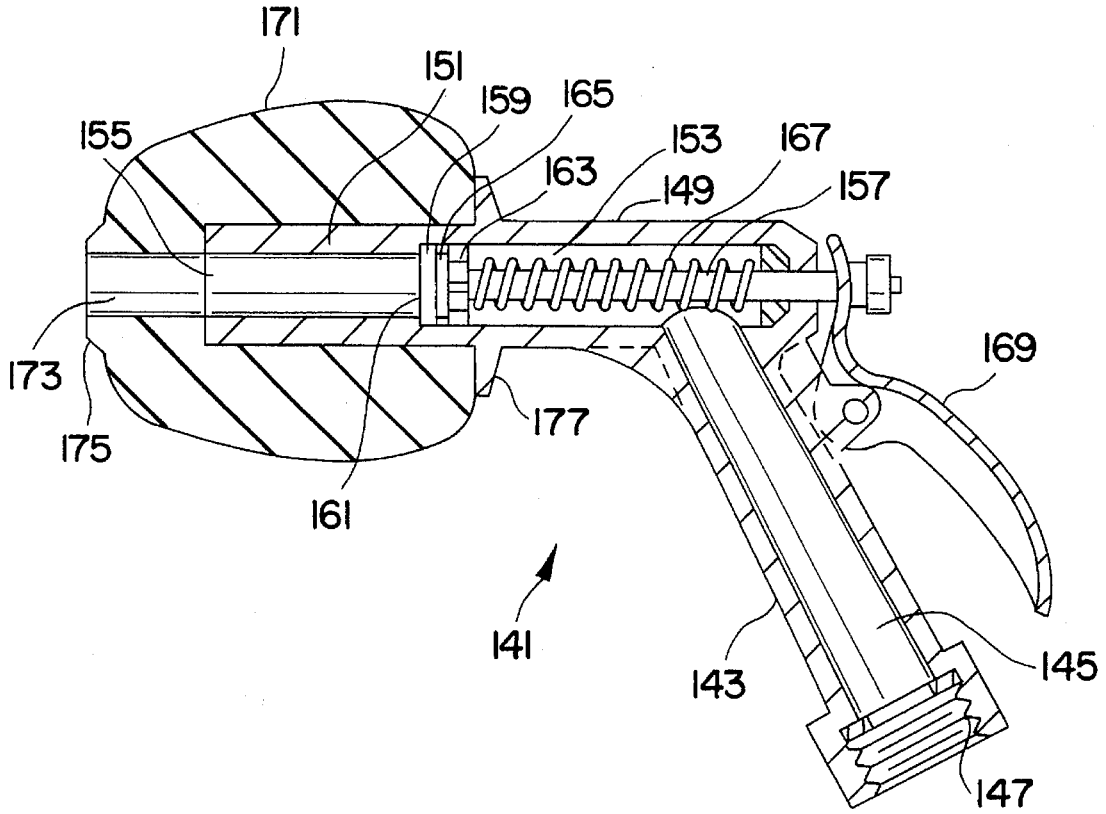
FIG. 13 of the drawings is an elevational view of a hand-held water pressure plunger according to this invention.

FIG. 13 of the drawings is a sectional view of a hand-held water pressure plunger 141 in accordance with this invention. Plunger 141 comprises a handle portion 143 having a first passage 145 defined therethrough and means 147 for connection to a pressurized water source. A main portion 149 is illustrated in FIG. 13 as connecting to handle portion 143 in communication therewith. The main portion 149 has an elongated section 151 with a second passage 153 defined therethrough which is in communication with first passage 145. Second passage 153 terminates in a circumferential orifice 155 in elongated section 151. A pressure valve stem 157 is positioned within second passage 153 for movement therein. A receiving structure 159 is fixedly positioned within second passage 153 and has a stationary orifice 161 defined therethrough. In the preferred embodiment, a slide guide 163 is fixedly positioned on valve stem 157 proximate to receiving structure 159. Slide guide 163 does not close off second passage 153, but rather is configured so as to allow a flow of pressurized water to pass by the slide guide through second passage 153. Positioned adjacent receiving structure 159 between stationary orifice 161 and slide guide 163 within second passage 153 is a rubber washer seal 165 which also has an orifice, not illustrated, defined therethrough for passage of the pressurized water. The slide guide 163 is designed to seal against washer 165 to prevent pressurized water flowing through the second passage from passing by washer 165.

Hand-held plunger 141 includes means for moving valve stem 157 from and to orifice 161 of receiving structure 159 whereby a flow of pressurized water flowing through the first passage and into the second passage can be controllably allowed to pass by slide guide 163 and then through washer 165 and orifice 161. Passing through the structures, the flow of pressurized water is then directed out of second passage 153 through circumferential orifice 155. Such means for moving the valve stem is illustrated in the preferred embodiment as comprising a spring 167 wound around valve stem 157 and a lever 169 which is pivotally attached to the exterior portion of plunger 141 and is attached to an end of the valve stem so that the lever can be pivotally moved to cause the valve stem with the slide guide fixed thereon to move away from the washer and the orifice of the receiving structure. The valve stem extends through plunger 141 for connection to lever 169 and the lever 169 is maintained in position around the valve stem by an adjustable nut.

For sealing against and clearing drains, hand-held plunger 141 further comprises a rubber member 171 having a central passage 173 defined therethrough which terminates in a nipple-shaped end 175. It is envisioned that the rubber member for attachment to hand-held plunger 141 can be similar or identical to rubber member 49 illustrated in FIGS. 1 through 3 except that there is no sleeve 59. Rubber member 171 in FIG. 13 does not include vent grooves 63 as there is no need for inclusion of vent grooves 63 for a rubber member attached to the hand-held plunger 141 since there is no compressible cup surrounding the rubber member. Inclusion of vent grooves 63 on rubber member 171, however, should have little or no effect on the performance the hand-held plunger 141, and it is envisioned that the sleeve 59 from the rubber member illustrated in FIGS. 1 through 3 can simply be removed and that rubber member can be attached to the hand-held plunger illustrated in FIG. 13 of the drawings. It is envisioned that the sleeve 59 of the rubber member 49 illustrated in FIGS. 1 through 3 also extends slightly beyond halfway through the central passage so that when the sleeve is removed from the rubber member illustrated in FIGS. 1 through 3, the rubber member can be placed on the elongated section 151 of the hand-held plunger so that it occupies substantially the same space within the central passage that the sleeve 59 occupied. Though it is envisioned that the rubber member be interchangeable, rubber member 171 is preferably fixedly secured to hand-held plunger 141.

The rubber member 171 illustrated in FIG. 13 and attached to the hand-held plunger 141 is preferably bullet-shaped. The elongated section 151 of the hand-held plunger extends within the central passage 173 of the rubber member, preferably to a point slightly beyond halfway through the central passage as illustrated in FIG. 13. The elongated section is embedded within the inner walls of the central passage so that a smooth and generally cylindrical inner passage is formed throughout the entire central passage.

Where the elongated section terminates within the central passage of the rubber member in FIG. 13, the central passage continues and terminates in nipple-shaped end 175. The extension of the rubber member and the central passage terminating in the nipple-shaped end past the end of the elongated section within the rubber member allows the rubber member to more flexibly seal against a drain opening. To provide added support and stability to the rubber member when the hand-held plunger is sealing against and clearing a drain opening, the exterior of the hand-held plunger 141 has a pressure disc 177 which is preferably formed thereon.

The hand-held plunger 141 according to this invention therefore holds and controls pressurized water by conventional use of a valve stem. It is envisioned that other conventional methods could be used to control pressurized water flow through the hand-held plunger.

Utilizing the hand-held plunger 141 of FIG. 13, it is therefore seen that a flow of pressurized water travels through first passage 145 into second passage 153 where it is held until the valve stem 157 is moved in a rearward direction to thereby allow the flow of pressurized water to pass by the slide guide 163 and through washer 165 and orifice 161 of the receiving structure 159. The flow of pressurized water then continues to travel through the central passage within the elongated section and exits the circumferential orifice 155. At this point , the flow of pressurized water passes through the central passage of the rubber member and exits the nipple-shaped end for clearing a drain opening. Hand-held plunger 141 is easy to use and advantageous in that it requires only one hand to use.

It is therefore seen that the present invention provides a multi-purpose water pressure plunger and process of using the same which is safe, easy to use and which connects to a standard source of pressurized water.

It is also seen that the present invention provides a multipurpose water pressure plunger with components that are interchangeable for sealing and clearing various drain openings.

It is further seen that the present invention provides a multi-purpose water pressure plunger which provides a removable attachment for sealing against smaller drain openings.

It is further seen that the present invention provides a multi-purpose, hand-held water pressure plunger and process of using the same which can also utilize a standard source of pressurized water to clear clogged drains.

As various modifications will become apparent to those of skill in the art from a reading of the above description, such modifications are embodied within the spirit and scope of this invention as measured by following the appended claims.

What is claimed is:

1. A multi-purpose water pressure plunger which sanitarily, efficiently, and dependably utilizes water pressure to clear clogged drains and the like comprising:

a compressible cup defining an interior cavity and having a solid rubber upper portion with a top and a bottom, said cup having an outer wall which extends to form a barrel-like bottom with edges for partially extending into and sealing against walls of a drain opening, said barrel-like bottom constructed of a substantially deformable rubberized material and defining a circumferential orifice;

said upper portion having a central passage defined therethrough, said passage beginning in a first opening at the top of said upper portion and terminating in a second opening positioned centrally in the bottom of said upper portion;

said outer wall and said interior cavity of said cup having an expansive portion proximate said upper portion and a narrow portion at said barrel-like bottom;

a firm, elongated handle attached to the top of said upper portion, said handle having a lengthwise aperture therethrough and having an open end which extends into said central passage; and a rubber member for fitting into drain openings extending from said bottom of said solid upper portion, said rubber member having a central passage defined therethrough coaxial and in direct communication with said central passage of said upper portion wherein said rubber member has a plurality of vent grooves defined on an outer surface of said rubber member, said grooves extending generally parallel to said central passage in said rubber member.

* * * * *